United States Patent [19]

Rochestie

[11] 4,049,125

[45] Sept. 20, 1977

[54] CARPET SAMPLE DISPLAY APPARATUS

[75] Inventor: Barnett B. Rochestie, Trenton, N.J.

[73] Assignee: Royal Engineering Company, Trenton, N.J.

[21] Appl. No.: 709,037

[22] Filed: July 27, 1976

[51] Int. Cl.[2] ..... A47F 7/16

[52] U.S. Cl. ..... 211/47; 24/81 CC; 211/124

[58] Field of Search ..... 40/128; 211/45, 46, 211/94, 47, 48, 206, 59, 124, 113, 96; 24/81, 67 R, 67.9, 67.11, 243 R, 243 P, 243 N, 255 R, 255 BS, 255 AS, 255 D, 255 S, 255 TC, 255 TH, 255 G, 255 P, 259 R, 259 GC, 259 PF

[56] References Cited

U.S. PATENT DOCUMENTS

| | | | |
|---|---|---|---|
| 991,922 | 5/1911 | Williams | 211/47 |
| 1,199,773 | 10/1916 | Ericson et al. | 211/46 |
| 2,246,692 | 6/1941 | Ohme | 211/206 X |
| 2,253,788 | 8/1941 | Kern | 211/46 X |
| 2,975,904 | 3/1961 | Krebs et al. | 211/46 |
| 3,225,922 | 12/1965 | Straight | 24/81 CC |
| 3,875,623 | 4/1975 | Johnston | 24/81 CC X |

FOREIGN PATENT DOCUMENTS

| | | | |
|---|---|---|---|
| 1,023,970 | 3/1966 | United Kingdom | 211/45 |

*Primary Examiner*—Roy D. Frazier

*Assistant Examiner*—Terrell P. Lewis

*Attorney, Agent, or Firm*—Albert Sperry; Frederick A. Zoda; John J. Kane

[57] ABSTRACT

A carpet sample display apparatus including a plurality of hanger members for holding a plurality of carpet samples extending downwardly to facilitate display thereof, the hanger members including a plurality of slotted channels adapted to receive carpet samples extending downwardly, the slotted channels including protruding tab flanges along the channel slots to fixedly secure the carpet sample into place within the slot of the channel, the hanger member further including a mounting sleeve along the upper side thereof, the entire hanger member being formed as a single extrusion of flexible material to facilitate gripping of the carpet samples, the mounting sleeve including a longitudinally extending sleeve slot therein such that when a mounting rod or hanger arm is placed within the sleeve the slot will expand to allow the sleeve to fixedly grip the supporting rod, the display apparatus including a plurality of such hanger arms extending from a support assembly which is maintained in fixed relationship with the surrounding environment by a frame assembly, the support means may include therein a plurality of holes to receive the hanger arms extending therethrough to allow for relative pivotal movement of the hanger arms to facilitate inspection of the displayed carpet samples.

10 Claims, 7 Drawing Figures

16
22
20
16
10
22
22
20
20
30
22
14
20
32
30
22
16
24
24
28
28
28
26
20

32
30
22
24
28
26

22
24
24
28
28
26
26

30
40
38
40
22
24
24
26

CARPET SAMPLE DISPLAY APPARATUS

BACKGROUND OF THE INVENTION b 1. Field of the Invention

The present apparatus deals with the field of displaying flat samples of floor coverings such as carpeting. In order to facilitate examination of a multiplicity of carpeting designs, various carpet sample display devices have been designed to more efficiently illustrate the available patterns. In this field it is desirable to show a plurality of samples or swatches capable of ready display while not occupying a large area of display space.

The apparatus of the present invention displays these carpet samples hanging vertically in a fan-like or overlapping fashion while still allowing the samples to be swung out of the customer aisle and thus minimizing the area of the store taken up by the display rack.

2. Description Of The Prior Art

Many displaying structures and fixtures have been shown in the prior art which require very complicated systems for gripping the carpet samples and securing these samples together in some type of orderly fashion for display. The present invention provides a simple system including a hanger which may be formed from a single extrusion which securely holds the carpet samples while at the same time maintaining them fixedly secured in an orderly fashion with respect to a support structure.

U.S. Pat. No. 2,946,454 shows a carpet sample display rack which utilizes the overlapping principle, however the display samples are mounted one upon another such that when a customer wishes to view a particular carpet sample, all samples overlapping thereabove must be lifted and held in the upright position during the period of viewing. These carpet samples are maintained in an overlapping fan-like configuration, however it is oriented in a vertical direction rather than in a horizontal direction. The applicant's design provides an independent source of support for each individual carpet sample. Another design in U.S. Pat. No. 1,021,358 which shows a swing-out display apparatus for use with rugs which clips the carpeting in a similar fashion to the present invention. However this design does not show the integral single extrusion which is simple and yet fully efficient as in the present design. The supporting sleeve of the present invention is integrally formed in one structure with the channels and tabs which grip the downwardly extending carpet sample.

SUMMARY OF THE INVENTION

The carpet sample display apparatus of the present invention includes a plurality of hanger arms for holding a plurality of display devices or hanger members extending downwardly therefrom. The hanger arms are secured at one end within a support means which holds the hanger arms in spaced relation with respect to one another and allows pivotal movement of the hanger arms with respect to the support means. The hanger members include at least one channel means extending downwardly therefrom which defines a longitudinally extending channel slot means for receiving and holding the carpet sample for display.

Integrally configured with the channel means is a mounting sleeve along the upper edge thereof which may be adapted to receive therein the hanger arms for securing the hanger members with respect to the support means. The mounting sleeve may preferably be tubular to receive a round or cylindrical hanger arm. Pivotal movement of the hanger arm will allow the customer to inspect each adjacently positioned and downwardly extending carpet sample mounted within the channel slot means.

In order to facilitate gripping of the carpet samples, the channel means may include flanges or tab means along the edges of the slot defined by the channel means which extend inwardly into contact with the carpet sample for holding in position within the channel means. Preferably the channel means as well as the entire hanger member is formed from a hard resilient material such as a plastic or the like to facilitate flexing movement of the edges of the channel slot to permit entry of the carpet sample into position within the channel means and thereafter assuring a firm gripping of the display piece upon releasing of the edges of the channel slot. To maintain the support means in spaced relation with respect to the wall or floor of the surrounding store environment, a frame assembly may be included to fixedly hold the support means. In this configuration the hanger arms may be formed as a rod having an elbow therein with a downwardly extending arm section. The downwardly extending arm section will extend through holes defined within the support means to allow pivotal movement of the downwardly extending arm section and thereby allowing a fan-like movement of the carpet samples with respect to one another.

To facilitate gripping of the hanger arms a slot may be defined along the upper edge of the mounting sleeve to allow flexible movement of the walls of the mounting sleeve. In this manner the sleeve slot may be biased into an opened position to allow insertion of the hanger arm therein. The edges of the slot may then be released to secure the hanger arm therein.

With this configuration a single extrusion may be utilized to form the hanger members, channels means, channel slot means, mounting sleeve and sleeve slot means as a single integral unit. In this manner the efficiency of the design will be improved as well as reducing the costs of manufacture and maintenance.

It is an object of the present invention to provide a carpet sample display apparatus which facilitates examination of many carpet designs by a customer while minimizing the amount of floor space required.

It is an object of the present invention to provide a carpet sample display apparatus which has minimal maintenance requirements.

It is an object of the present invention to provide a carpet sample display apparatus which includes a movable carpet securing device to facilitate examination of the samples.

It is an object of the present invention to provide a carpet display device which maintains independent support for each carpet sample directly from the frame or support means.

It is an object of the present invention to provide a carpet sample display apparatus of the swinging arm selector type in which the carpet samples are maintained in orderly spaced orientation with respect to one another and are easily removed or replaced within the display.

It is an object of the present invention to provide a swinging carpet display system which includes a sleeve and slot mounting system which is easily convertible to receive a handle device to facilitate removal of samples from the area of the display rack.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figures 1, 4, 5, 6, 7:
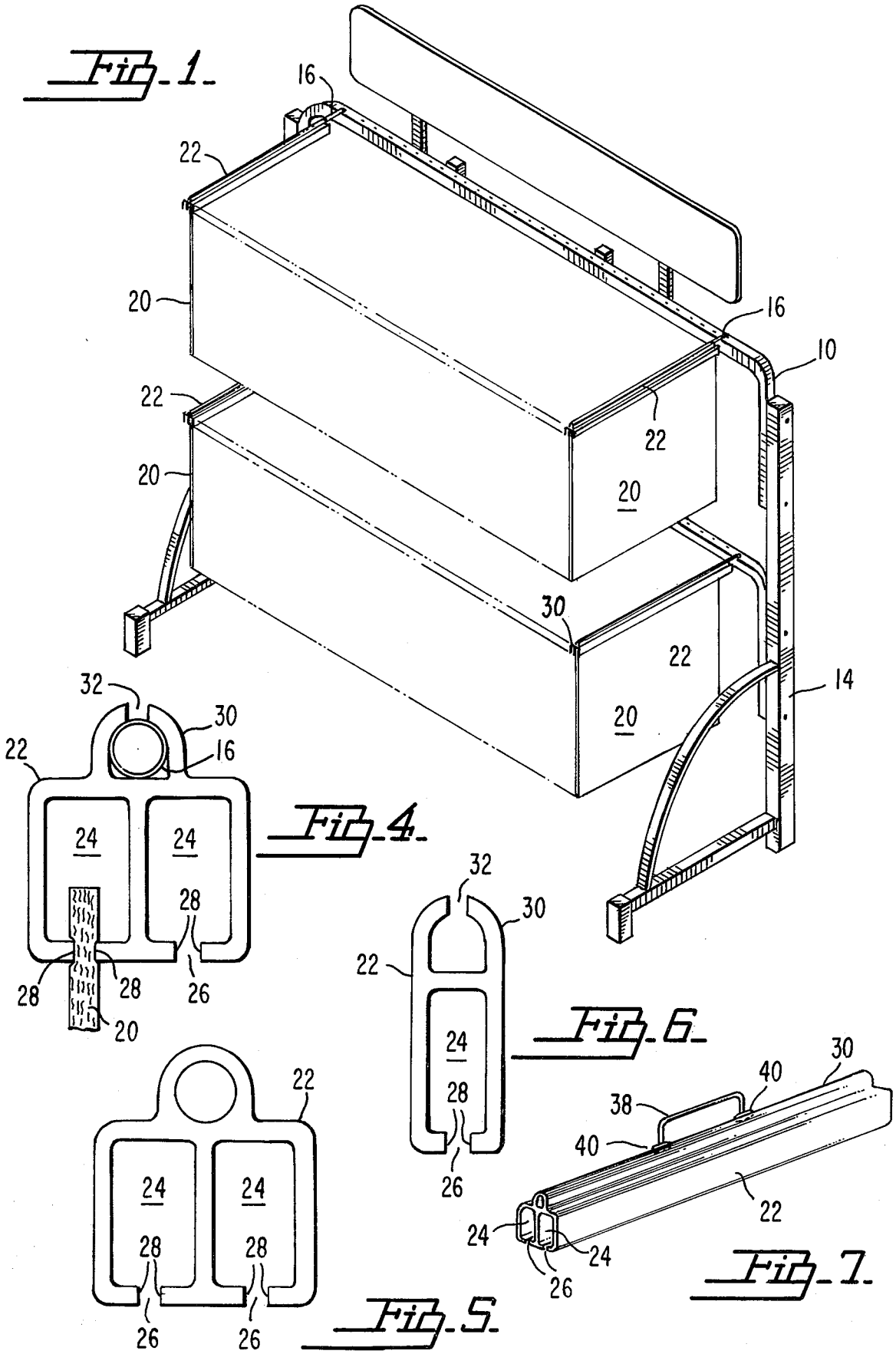
FIG. 1 is a perspective view of an embodiment of the carpet sample display apparatus of the present invention.
FIG. 4 is a cross-sectional view of an embodiment of a hanger arm of the present invention including two channel means and showing the slotted mounting sleeve.
FIG. 5 is a cross-sectional view of another embodiment of the hanger member of the present invention.
FIG. 6 is a cross-sectional view of another embodiment of the hanger member of the present invention.
FIG. 7 is a perspective view of the embodiment shown in FIG. 4 including the handle means shown positioned within the mounting sleeve.

The present invention is a carpet sample display apparatus 10 of the swinging arm variety in which customers may selectively examine vertically supported and horizontally overlapping carpet samples 20. The display rack includes a frame assembly generally designated as 14 which holds a support means 12. A plurality of hanger arms 16 may be configured to be mountable within holes 18 in the support means 12 and thereby be secured thereto for pivotal movement.

Each of the hanger arms 16 is adapted to have secured thereto a hanger member 22 which holds the individual carpet samples 20. The hanger member 22 includes channel means 24 along the lower edge thereof which defines at least one channel slot means 26 therein. The carpet sample 20, when fixed in the display location, will project upwardly through the channel slot means 26 and be secured therein by tab means 28 along the edges of the channel slot means 26.

The hanger members 22 may also include a mounting sleeve 30 into which the forwardly protruding section of hanger arms 16 may be located. To assure a firm connection between the mounting sleeve 30 and the hanger arms 16 a longitudinally oriented sleeve slot means 32 may be defined by the mounting sleeve 30. In this configuration when the hanger member 22 is to be installed onto the hanger arm 16 the edges of the sleeve slot means 32 may be separated to increase the internal diameter of the mounting sleeve 30 such that the diameter of the rod of the hanger arm 16 is accepted therein. Then, the inside walls of the mounting sleeve 30 will securely grip the hanger arm 16.

In one embodiment of the present invention the hanger arm 16 may include an elbow 34 therein separating the main section of the hanger arm from the downwardly extending arm section 36. In this configuration the downwardly extending arm section 36 will extend through holes 18 in the support means 12 to provide a firm means of attachment between the hanger members 22 and the support means 12 which still allows pivotal movement therebetween. When the mounting sleeve 30 is configured with the sleeve slot means 32 therein a handle means 38 as shown in FIG. 7 will provide an easy manner of using the hanger arm 16 as a portable carrying apparatus. The handle means 38 includes beads 40 at the mounting points of the handle such that these beads may be slid into the mounting sleeve 30 from one end of the hanger arm 16 with the handle means itself extending through the sleeve slot means 32 to thereby provide a handle for carrying the hanger arm 16 and the mounted carpet samples 20.

A basic embodiment of the present invention is shown in FIG. 6 in which a single channel means 24 is shown formed integrally with a mounting sleeve 30 thereabove. This entire unit may be formed as a single extrusion to minimize production costs and maintenance problems. In this embodiment the sleeve slot means 32 is shown along the upper edge of the hanger member 22 to facilitate placement of the hanger arm 16 within mounting sleeve 30 of the hanger member 22.

Another embodiment showing two channel means 24 is shown in FIG. 4. The carpet sample 20 is shown positioned within one of the channel means 24 and fixed in position by the biasing relationship between tab means 28. When formed as a single extrusion the hanger member 22 of the present invention is preferably formed from a flexibly resilient material such that the tab means 28 may be manually biased apart from one another to allow insertion of the carpet sample 20 therebetween and to further provide a firm gripping of the carpet sample 20 when the tab means 28 are released. In this fashion the carpet samples 20 positioned within the plurality of hanger members 22 will be firmly secured in place for display.

When formed as a single extrusion the walls of the mounting sleeve 30 will also be flexibly resilient. With this property the sleeve slot means 32 may be biased apart to increase the internal diameter of the mounting sleeve 30. The hanger arm 16 will therefore pass easily into the sleeve 30 as the hanger member 22 is placed onto the display apparatus 10. Once in place the sleeve slot means 32 is released and a firm attachment between the arms 16 and the sleeve 30 is established. Thus, the display of the carpet samples extending below the hanger member 22 is facilitated by the above firm attachment and by the pivotal movement possible between the hanger arms 16 and the holes 18 of the support means 12.

It should be appreciated that any number of channel means 24 may be formed in the single extrusion process and thereby provide a multiplicity of downwardly extending carpet samples 20 from each single hanger member 22. With these configurations only a single mounting sleeve 30 will be required along the upper surface of the hanger member 22. As shown in FIG. 5 the mounting sleeve 30 may be round in cross-section and need not include sleeve slot means 32. In this configuration the internal diameter of the mounting sleeve 30 should be slightly larger than the outside diameter of the hanger arms 16 to facilitate secure placement therein.

Figure 2:
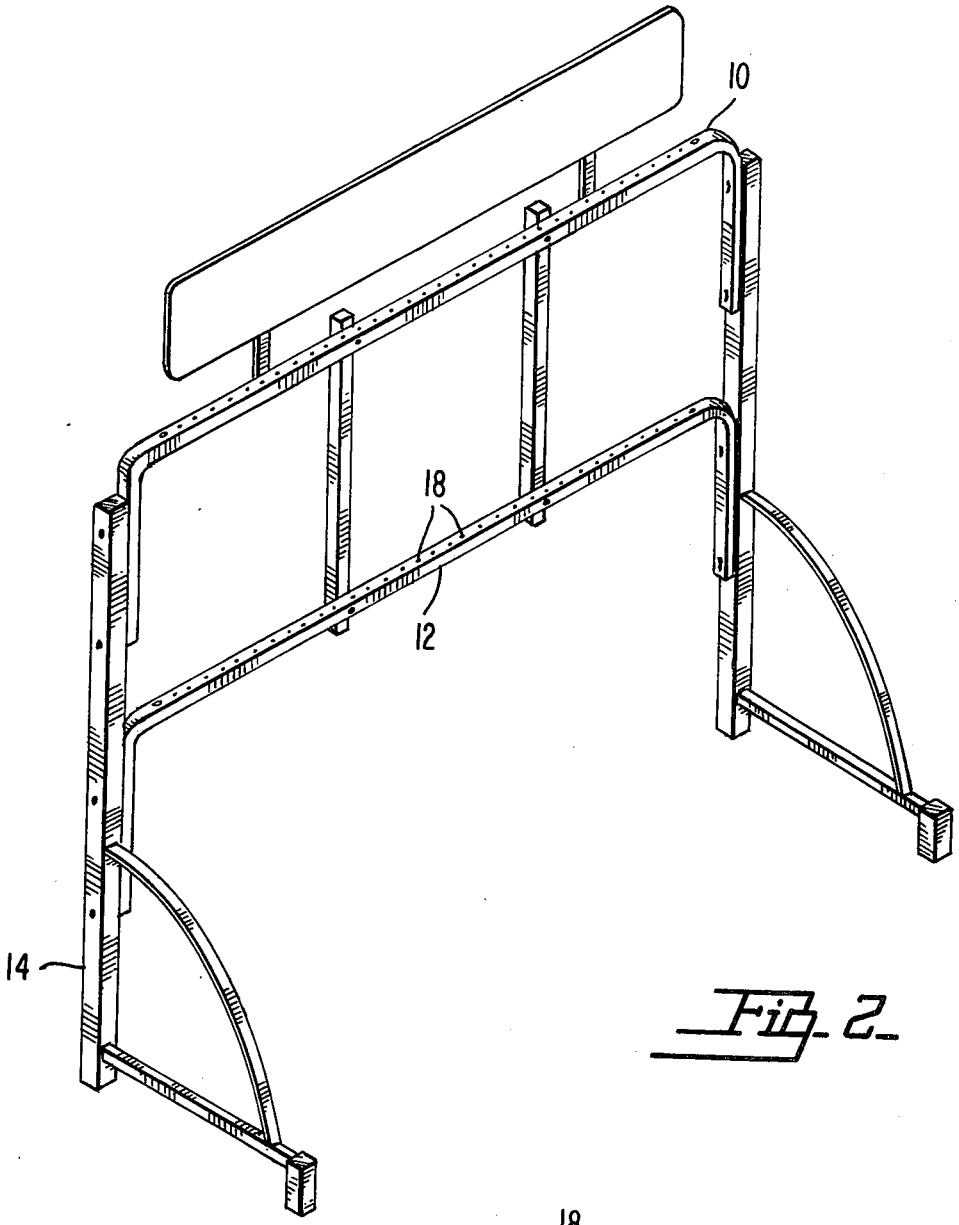
FIG. 2 is a perspective view of the support means and frame assembly of the apparatus shown in FIG. 1.
Figure 3:
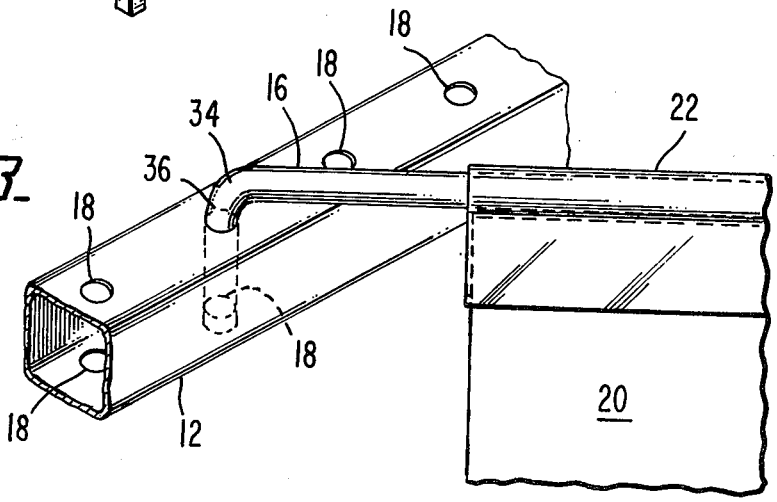
FIG. 3 is a perspective view of an embodiment of the hanger arm assembly of the apparatus shown in FIG. 1.

As shown in FIG. 2 the holes 18 within the support means 12 may be positioned at fixed distances from one another to facilitate an orderly display of the carpet samples 20. Within a single frame assembly 14 more than one support means 12 may extend horizontally. Each hole 18 is adapted to receive the downwardly extending arm section 36 of hanger arm 16. The receiving hole 18 may be formed as a double hole arrangement at opposite sides of a hollow tubular support means 12. In this configuration the downwardly extending arm section 36 will extend through the tube means and through both holes and thereby provide a firm means of support as well as allowing full pivotal movement of the hanger arm 16 within the support means 12.

When the hanger members 22 are configured including a sleeve slot means 32 within mounting sleeve 30, a handle means 38 may be usable therewith by the placement of beads 40 on opposite ends of the handle into a location within the mounting sleeve 30. In this manner the individual hanger members 22 including the downwardly extending carpet samples 20 mounted therein may be portably carried to facilitate examination.

While particular embodiments of this invention have been shown in the drawings and described above, it will be apparent that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A carpet sample display apparatus comprising:

a. a plurality of pivotally moveable hanger arms;

b. support means for holding said hanger arms in spaced relation, with respect to one another and the surrounding environment, said hanger arms being pivotally movably mounted within said support means; and c. a plurality of hanger members for holding a plurality of carpet samples extending downwardly therefrom for display, said hanger members further comprising:

1. at least one downwardly extending channel means which defines a longitudinally extending channel slot means for receiving and holding the carpet samples for display;

2. a mounting sleeve adapted to receive one of said hanger arms therein to secure said hanger member to said support means, said mounting sleeve defining a sleeve slot means extending longitudinally therealong to allow flexing of the walls of said mounting sleeve to facilitate gripping of said hanger arms; and 3. tab means along the edges of said channel slot means and extending into said channel means to hold displayed carpet samples therein.

2. The apparatus as defined in claim 1 wherein said mounting sleeve is integrally configured with said channel means.

3. The apparatus as defined in claim 1 wherein each of said hanger means is a single integral extrusion forming said mounting sleeve and said channel means.

4. The apparatus as defined in claim 1 wherein said hanger member is formed of a resilient material to facilitate gripping of the carpet sample within said channel slot means.

5. The apparatus as defined in claim 1 wherein said mounting sleeve is tubular.

6. The apparatus as defined in claim 1 wherein each of said channel means is of a rectangular cross-section.

7. The apparatus as defined in claim 1 further including a frame assembly for holding said support means in spaced relationship with respect to ground level.

8. The apparatus as defined in claim 1 wherein said hanger arm is round in cross-section.

9. The apparatus as defined in claim 1 wherein said support means defines holes therein through which said hanger arms extend to be held therein for pivotal movement.

10. A carpet sample display apparatus comprising:

a. a plurality of pivotally moveable hanger arms;

b. support means for receiving and holding said hanger arms in spaced relation with respect to one another, said hanger arms being pivotally movably mounted to said support means;

c. a frame assembly for holding said support means in spaced relation to surrounding environmental structure;

d. a plurality of hanger members for holding a plurality of carpet samples extending downwardly therefrom for display, said hanger members being a single integral extrusion formed of resilient material to aid in gripping said hanger arms and the carpet display samples, said hanger members further comprising:

1. at least one downwardly extending channel means which defines a longitudinally extending channel slot means for receiving and holding the carpet sample for display;

2. tab means along the edges of said slot means to facilitate securing of the carpet display sample within said channel slot means; and 3. a round mounting sleeve adapted to receive one of said hanger arms therein to secure said hanger member to said support means, said sleeve defining a sleeve slot means extending longitudinally therealong to provide further resiliency to said sleeve to facilitate gripping of said hanger arms.

* * * * *

UNITED STATES PATENT OFFICE

CERTIFICATE OF CORRECTION

Patent No. 4,049,126 Dated September 20, 1977

Inventor(s) Lance K. Halverson

It is certified that error appears in the above-identified patent and that said Letters Patent are hereby corrected as shown below:

Column 7, Claim 2, Line 41, change "bar" to --bat--

Column 8, Claim 8, Line 17, change "bar" to --bat--

Column 8, Claim 9, Line 27, after "edges," insert --ends--

Column 8, Claim 9, Line 34, change "or" to --of--

Column 8, Claim 9, Line 42, change "and" to --for--

Signed and Sealed this

*Tenth* Day of *January 1978*

[SEAL]

*Attest:*

RUTH C. MASON
*Attesting Officer*

LUTRELLE F. PARKER
*Acting Commissioner of Patents and Trademarks*